US009527289B2

(12) United States Patent
Nagase et al.

(10) Patent No.: US 9,527,289 B2
(45) Date of Patent: Dec. 27, 2016

(54) RECORDING DEVICE

(71) Applicant: SEIKO EPSON CORPORATION, Tokyo (JP)

(72) Inventors: Masachika Nagase, Fujimi-machi (JP); Kazumasa Harada, Matsumoto (JP); Hirohisa Adachi, Matsumoto (JP); Eiji Taketsugu, Matsumoto (JP); Kazuhisa Takeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 31 days.

(21) Appl. No.: 13/935,213

(22) Filed: Jul. 3, 2013

(65) Prior Publication Data

US 2014/0009532 A1 Jan. 9, 2014

(30) Foreign Application Priority Data

Jul. 6, 2012 (JP) ..... 2012-152157

(51) Int. Cl.
*B41J 2/165* (2006.01)
*B41J 2/17* (2006.01)

(52) U.S. Cl.
CPC ..... *B41J 2/16517* (2013.01); *B41J 2/165* (2013.01); *B41J 2/16526* (2013.01); *B41J 2/1721* (2013.01); *B41J 2002/1742* (2013.01)

(58) Field of Classification Search
None
See application file for complete search history.

(56) References Cited

U.S. PATENT DOCUMENTS

| | | | | |
|---|---|---|---|---|
| 4,947,190 | A * | 8/1990 | Mizusawa | B41J 2/16535 347/33 |
| 7,204,577 | B2 * | 4/2007 | Kanamitsu | B41J 2/16523 347/31 |
| 2002/0033860 | A1 * | 3/2002 | Kubota et al. | 347/36 |
| 2013/0050378 | A1 * | 2/2013 | Okamoto | 347/104 |

FOREIGN PATENT DOCUMENTS

| | | |
|---|---|---|
| JP | 11-028824 | 2/1999 |
| JP | 2002-086757 | 3/2002 |
| JP | 2004-230806 | 8/2004 |
| JP | 2006-130662 | 5/2006 |
| JP | 2007-118433 | 5/2007 |
| JP | 2012-091408 | 5/2012 |

* cited by examiner

*Primary Examiner* — Alejandro Valencia
(74) *Attorney, Agent, or Firm* — Workman Nydegger

(57) ABSTRACT

A recording device includes a liquid ejection head, a support unit that support a paper sheet, a transportation path along which the paper sheet is reversed and transported, and a transportation roller that transports the paper sheet, wherein a liquid absorbent is provided downstream in the transportation direction of the paper sheet relative to the transportation roller, and liquid absorbents are provided upstream in the transportation direction of the paper sheet relative to the transportation roller, and second liquid absorbent is provided between the liquid absorbent and the liquid absorbent.

15 Claims, 15 Drawing Sheets

RECORDING DEVICE

BACKGROUND

1. Technical Field

The present invention relates to recording devices.

2. Related Art

Ink jet recording devices include devices that eject ink from a liquid ejection head onto a recording medium such as a paper sheet so as to perform printing on the paper sheet without margins. In such ink jet recording devices, channels are formed on a support unit that supports the paper sheet so that ink ejected outside of the end of the paper sheet lands on the channels. When ejected ink lands on the bottom of the channels, ink mist is generated and is attached to the paper sheet and nozzles of the liquid ejection head. For example, JP-A-2002-86757 describes that an ink absorbent is placed in the channels so that ink ejected outside of the end of the paper sheet lands on the ink absorbent to prevent ink mist from being generated.

However, in order to perform printing of a specified number of sheets, ink absorbent having a size sufficient to absorb a specified amount of ink needs to be placed in the channels, since the amount of ink absorbed by the ink absorbent increases as the number of printing sheets increases. This causes a problem in achieving small-sized ink jet recording devices, especially in achieving low profile ink jet recording devices. Further, when the ink absorbent is replaced after the amount of ink absorbed by the ink absorbent reaches the ink absorbing capacity of the ink absorbent, replacement of the ink absorbent is not easy since the ink absorbent is placed in the channels.

SUMMARY

An advantage of some aspects of the invention is that a recording device that can be implemented as the following embodiments or application examples can be provided.

Application Example 1

A recording device includes a liquid ejection head that ejects liquid onto a recording medium that is transported; an area where the liquid is ejected from the liquid ejection head; a transportation path that is located between a medium supply unit that supplies the recording medium and a medium ejection unit that ejects the recording medium; and a liquid absorbent that absorbs the ejected liquid in the area, wherein the liquid absorbent is positioned at least along a surface of the transportation path which is outside of the area.

According to the application example 1, the liquid absorbent is positioned at least along a surface of the transportation path which is outside of the area. Accordingly, even if the amount of liquid absorbed by the liquid absorbent increases, it is possible to prevent the recording device from increasing in size.

Application Example 2

The recording device in the application example 1 further includes a transportation roller that is provided upstream in the transportation direction of the recording medium relative to the liquid ejection head, wherein at least a portion of the liquid absorbent is positioned upstream in the transportation direction relative to the transportation roller.

According to the application example 2, since the liquid absorbents can be positioned away from each other, the thickness and the width of the liquid absorbents can be small, thereby decreasing the size of the recording device.

Application Example 3

The recording device in the application example 1 further includes a transportation roller that is provided upstream in the transportation direction of the recording medium relative to the liquid ejection head, wherein at least a portion of the liquid absorbent is positioned downstream in the transportation direction relative to the transportation roller.

According to the application example 3, since the liquid absorbents can be positioned away from each other, the thickness and the width of the liquid absorbents can be small, thereby decreasing the size of the recording device.

Application Example 4

The recording device in the application example 1 further includes a transportation roller that is provided upstream in the transportation direction of the recording medium relative to the liquid ejection head, wherein the liquid absorbents are positioned upstream and downstream in the transportation direction relative to the transportation roller.

According to the application example 4, since the liquid absorbents can be positioned away from each other, the thickness and the width of the liquid absorbents can be small, thereby decreasing the size of the recording device.

Application Example 5

In the recording device in the application example 4, the liquid absorbent is composed of an upstream liquid absorbent that is positioned upstream in the transportation direction relative to the transportation roller, downstream liquid absorbent that is positioned downstream in the transportation direction relative to the transportation roller, and a connection liquid absorbent that connects the upstream liquid absorbent and the downstream liquid absorbent.

According to the application example 5, since the liquid absorbents can be positioned away from each other, the thickness and the width of the liquid absorbents can be small, thereby decreasing the size of the recording device.

Application Example 6

In the recording device in the application example 5, the connection liquid absorbent is formed by a member different from that of the upstream liquid absorbent and the downstream liquid absorbent.

According to the application example 6, in spite of the thickness and the width of the connection liquid absorbent being smaller than the thickness and the width of the upstream liquid absorbents and the downstream liquid absorbent, it is possible to prevent the amount of ink flowing between the upstream liquid absorbent and the downstream liquid absorbent from decreasing. Accordingly, a space for placing the connection liquid absorbent does not need to be large, thereby preventing the recording device from increasing in size.

Application Example 7

The recording device in the application examples 1 to 6 further includes a transportation path along which the recording medium is reversed and transported, wherein the liquid absorbent extends under the transportation path.

According to the application example 7, the thickness and the width of the liquid absorbents can be small, thereby decreasing the size of the recording device.

Application Example 8

The recording device in the application example 7 further includes a reversing unit having a reversing roller that reverses and transports the recording medium, wherein the liquid absorbent is positioned so as to overlap with the reversing roller in the transportation direction.

According to the application example 8, even if the amount of the liquid absorbed by the liquid absorbent increases, it is possible to prevent the recording device from increasing in size.

Application Example 9

The recording device in the application example 8 further includes a liquid absorbent container that houses at least a portion of the liquid absorbent and is detachably mounted in the transportation path, wherein a wall of the liquid absorbent container forms part of the transportation path.

According to the application example 9, since the liquid absorbent container can be removed from the transportation path, and after the liquid absorbent is replaced, the liquid absorbent container can be mounted in the transportation path, replacement of the liquid absorbent can be easily performed.

Application Example 10

In the recording device in the application example 9, the reversing unit is detachably mounted on a frame, and the wall of the liquid absorbent container is exposed when the reversing unit is removed from the frame.

According to the application example 10, since a user can remove the absorbent container from the transportation path and mount the absorbent container again in the transportation path with the reversing unit being removed from the frame, replacement of the liquid absorbent can be easily performed.

Application Example 11

The recording device in the application example 10 further includes a feed cassette on which the recording medium is placed; and a feed roller that feeds the recording medium placed on the feed cassette, wherein the liquid absorbent is positioned so as not to overlap with the feed roller in the movement direction of the liquid ejection head.

According to the application example 11, the recording device can be made low profile.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the drawings. The terms "upper," "lower," "above," "under" as used herein refer to the direction in the vertical direction.

Figure 1A:
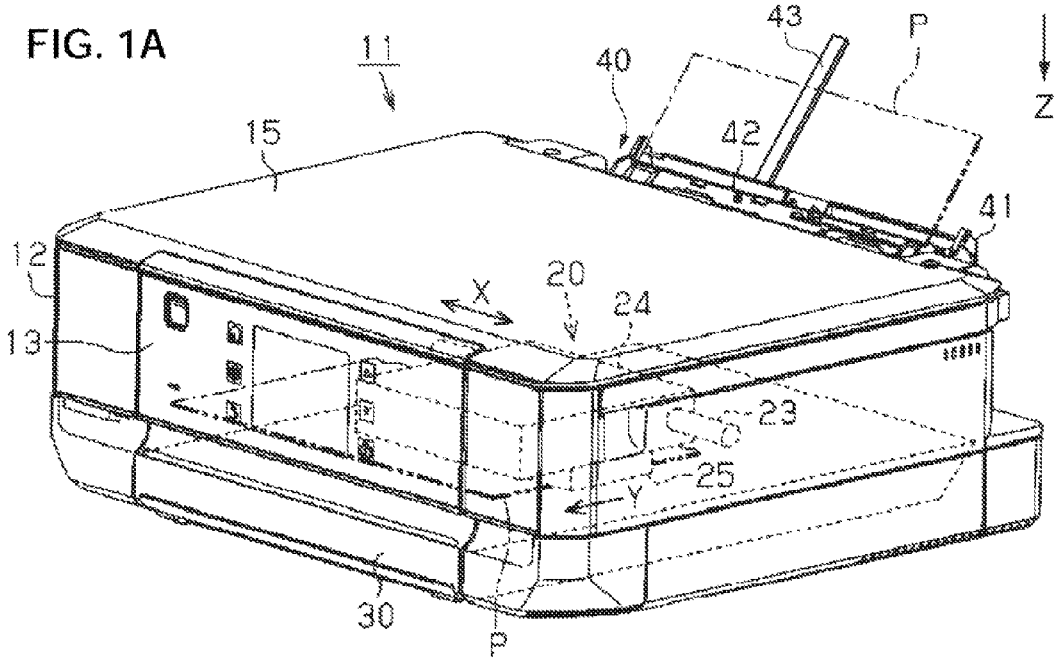
FIG. 1A is an appearance perspective view of a recording device as seen from the front side.
Figure 1B:
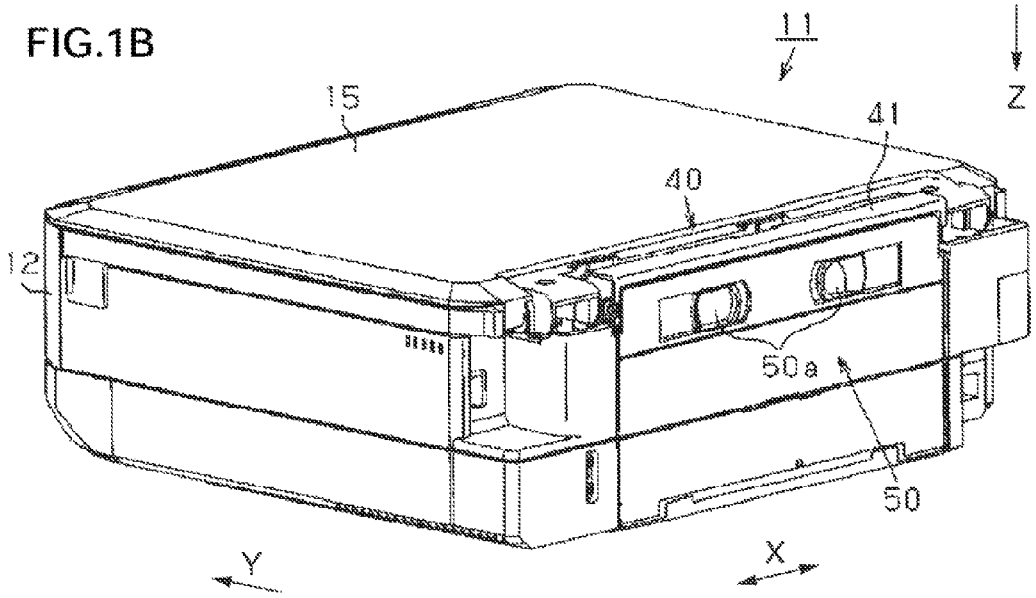
FIG. 1B is an appearance perspective view of the recording device as seen from the back side.

FIG. 1A is an appearance perspective view of a recording device 11 as seen from the front side, and FIG. 1B is an appearance perspective view of the recording device 11 as seen from the back side. The recording device 11 according to the embodiment includes a device main body 12 which has a substantially cuboid shape formed by a plurality of housings, a recording unit 20 that is configured to record images or the like by ejecting ink in the form of liquid onto a paper sheet P which is a recording medium, and a sheet feeding cassette 30 which is a feed cassette in which paper sheets (not shown in the figure) can be placed in a stacked state.

An operation panel 13 is disposed on the front face of the device main body 12, which is downstream in a transportation direction Y of the paper sheet P, and an image reading unit 15 such as a scanner is disposed in the upper portion of the device main body 12 in the vertical direction Z.

The operation panel 13 includes, for example, a display such as a liquid crystal display for displaying a menu screen and the like and an operation unit such as operation buttons. The operation panel 13 is pivotally mounted on the device main body 12 about a rotation mechanism such as a hinge disposed on the upper side of the operation panel 13 and is configured to open when the lower end is turned upward.

A paper ejection port (not shown in the figure) is disposed on the front face of the device main body 12 on which the operation unit of the operation panel 13 is disposed. The paper ejection port is exposed when the operation panel 13 opens so that the paper sheet P is ejected from the recording unit 20 to the outside of the device main body 12 through the paper ejection port in the transportation direction Y.

The sheet feeding cassette 30 is removably inserted into the device main body 12 at a position under the operation panel 13. The paper sheets P placed in the sheet feeding cassette 30 are fed out by a feed roller (not shown in the figure) to a transportation path of the paper sheet which is located at the back in the insertion direction (back side) and is transported to the recording unit 20.

In addition to the sheet feeding cassette 30, a manual sheet feeding mechanism 40 is disposed on the recording device 11 at the upper back side of the device main body 12 so that the paper sheets P are manually supplied one by one.

The manual sheet feeding mechanism 40 has an opening as an insertion port 42 through which the paper sheet P is inserted and a cover 41 that is swingably mounted on the device main body 12 so as to openably cover the insertion port 42. When the paper sheet P is not supplied by the manual sheet feeding mechanism 40, the cover 41 is in a closed state as shown in FIG. 1B to prevent foreign matters such as dust from entering into the insertion port 42.

As shown in FIG. 1A, a paper sheet support 43 in an elongated plate shape is disposed on the back side of the recording device 11 so that the paper sheet P inserted into the insertion port 42 is supported by the paper sheet support 43. The paper sheet support 43 pivots about one end on the side of the insertion port 42 and can be housed in a wall that forms the insertion port 42. The paper sheet support 43 is pulled out when the paper sheet P is set in the insertion port 42.

A guide shaft 23 extends in the device main body 12 in a width direction X which is perpendicular to the transportation direction Y of the paper sheet P. A carriage 24 is supported on the guide shaft 23 in a manner movable in the width direction X. The carriage 24 reciprocated in the width direction X when driven by a carriage motor, which is not shown in the figure.

A liquid ejection head 25 that ejects ink and performs recording (printing) onto the paper sheet P is supported on the underside of the carriage 24. When the carriage 24 moves, the liquid ejection head 25 moves while ejecting ink from the liquid ejection head 25. The paper sheet P is fed in the transportation direction Y (intermittent feeding) by driving a sheet feeding motor (which is not shown in the figure) and ejected to the outside of the device main body 12 through an ejection port which is a medium ejection unit.

While the carriage 24 moves in the width direction X along the guide shaft 23 and the paper sheet P moves in the transportation direction Y, ink is ejected from the liquid ejection head 25 onto the paper sheet P, thereby performing recording. The recording unit 20 is composed of the carriage 24, the liquid ejection head 25 and the guide shaft 23. A plurality of ink cartridges (not shown in the figure) that contain ink are disposed in the device main body 12, so that ink is supplied from the ink cartridges to the liquid ejection head 25.

As shown in FIG. 1B, a reversing unit 50 is provided on the back side of the recording device 11 so as to reverse and transport the paper sheet P. The reversing unit 50 is disposed on a frame above the sheet feeding cassette 30. The reversing unit 50 serves to reverse the front and back sides of the paper sheet P, that is, the surface to be recorded, to perform double-sided printing on the paper sheet P which is to be supplied to the recording unit 20.

Figure 2:
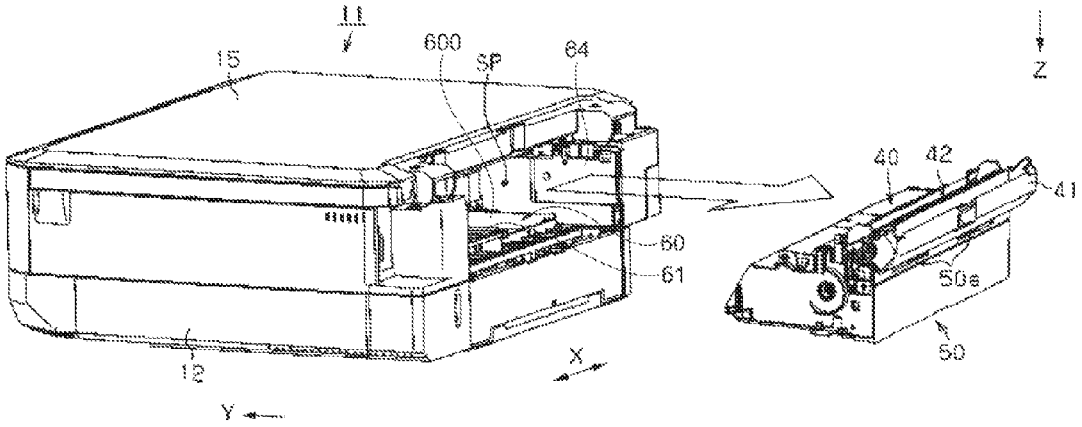
FIG. 2 is an appearance perspective view which shows that a reversing unit is removed from the recording device.

FIG. 2 is an appearance perspective view from the back side of the recording device 11 and shows that a reversing unit 50 is removed from the recording device 11. The reversing unit 50 is detachably mounted on the frame 64. A user can remove the reversing unit 50 from the device main body 12 by pulling out the reversing unit 50 backward from the device main body 12.

On the surface of the reversing unit 50 which is exposed when attached to the device main body 12, a pair of operation units 50*a* (see FIG. 1B) are disposed. The user can insert his/her finger into the operation units 50*a* so as to grip to slide the operation units 50*a*. When the user slides the operation units 50*a* toward each other, the reversing unit 50 is disengaged from the device main body 12 and can be pulled out backward from the device main body 12.

When the reversing unit 50 is removed from the frame 64, a space SP is created on the back side of the device main body 12 such that a transportation path 61 and a cartridge 60 that form part of the transportation path 61 are exposed from the back side as shown in FIG. 2. This allows the user to remove the paper sheet P remaining in the transportation path 61 due to paper jam and the like. Further, the user can remove and attach the cartridge 60 in the state that the reversing unit 50 is removed from the frame 64.

Figure 3A:
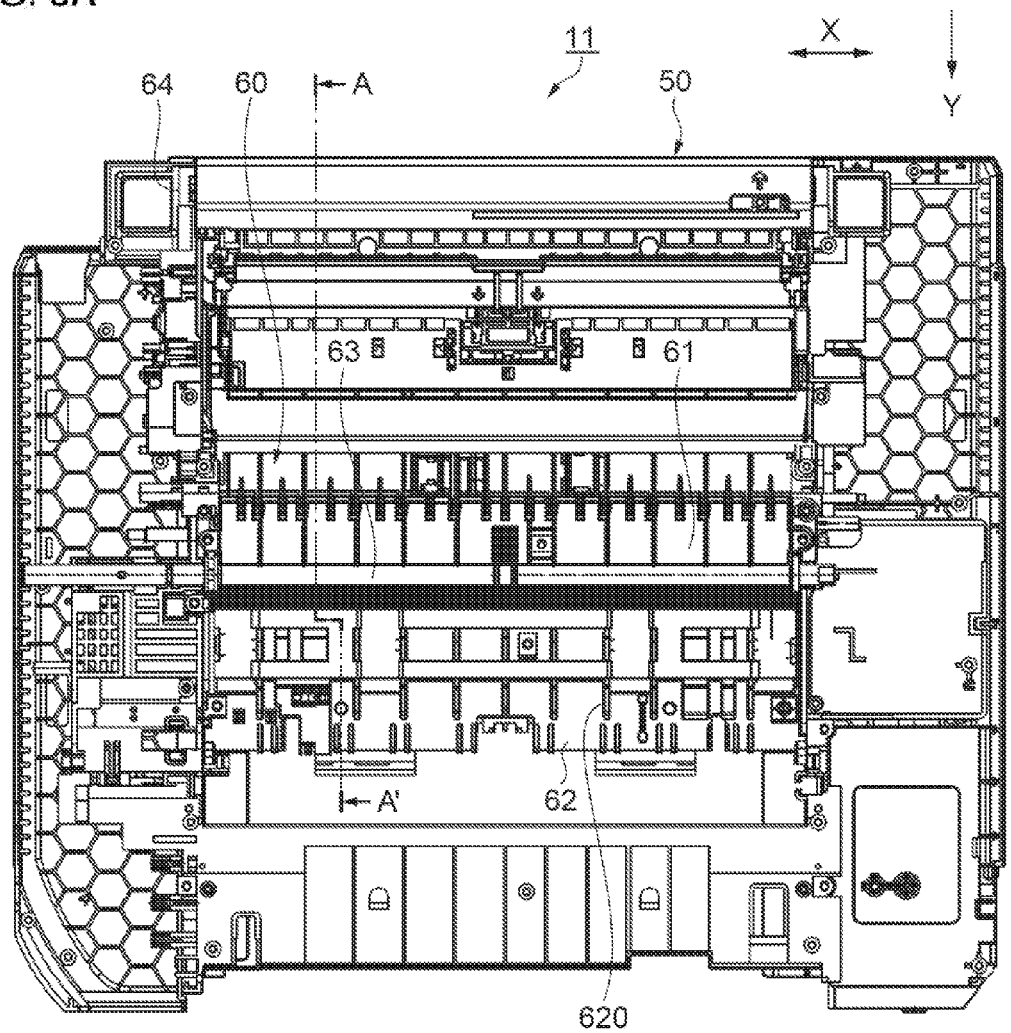
FIGS. 3A and 3B are plan views of the recording device.

FIG. 3A is a plan view of the recording device 11 from the above in the state that the image reading unit 15, the recording unit 20, the operation panel 13 and the sheet feeding cassette 30 of FIG. 1A are removed. A support unit 62 is disposed at a position which opposes the liquid ejection head 25 of FIG. 1A in the vertical direction Z. A plurality of ribs 620 each extending upward in the transportation direction Y are arranged in the width direction X on the support unit 62. The ribs 620 abut against the underside of the paper sheet P which is transported in the transportation direction Y and support the paper sheet P.

Figure 3B:
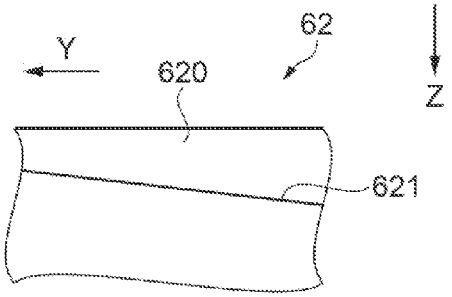

FIG. 3B is a sectional view of the support unit 62 in the width direction X. A support surface 621 is connected to the underside of the ribs 620 and supports the ribs 620. The support surface 621 is inclined relative to the horizontal direction and allows ink ejected from the liquid ejection head 25 onto the support surface 621 to flow along the support surface 621.

A transportation roller 63 that is driven by the sheet feeding motor is disposed upstream in the transportation direction Y relative to the support unit 62. A driven roller (not shown in the figure) that is driven by the rotation of the transportation roller 63 is disposed above the transportation roller 63. The paper sheet P is transported between the rotating transportation roller 63 and the driven roller.

The transportation path 61 is disposed upstream in the transportation direction Y relative to the transportation roller 63 and supports the underside of the paper sheet P that is transported. The reversing unit 50 is mounted on the frame 64 on the back side of the recording device 11 and above the transportation path 61. The cartridge 60 is disposed under the reversing unit 50.

The paper sheet P which is supplied from the sheet feeding cassette 30 or the manual sheet feeding mechanism 40 of FIG. 1A is then transported along the transportation path 61 of FIG. 3A and is supplied to the recording unit 20. In performing double-sided printing, after printing is performed on one side of the paper sheet P by the recording unit 20, the paper sheet P is transported upstream in the transportation direction Y along the transportation path 61. The paper sheet P is curved by the reversing unit 50 with the printed surface facing inward and is then reversed so that the printed surface faces downward. Then, the reversed paper sheet P is transported downstream in the transportation direction Y along the transportation path 61, and printing is performed on the other side of the paper sheet P by the recording unit 20.

The sheet feeding cassette 30, the manual sheet feeding mechanism 40 and the reversing unit 50 serve as a medium supply unit. The transportation path along the paper sheet P is transported is formed between the medium supply unit and a medium ejection unit.

Figure 4:
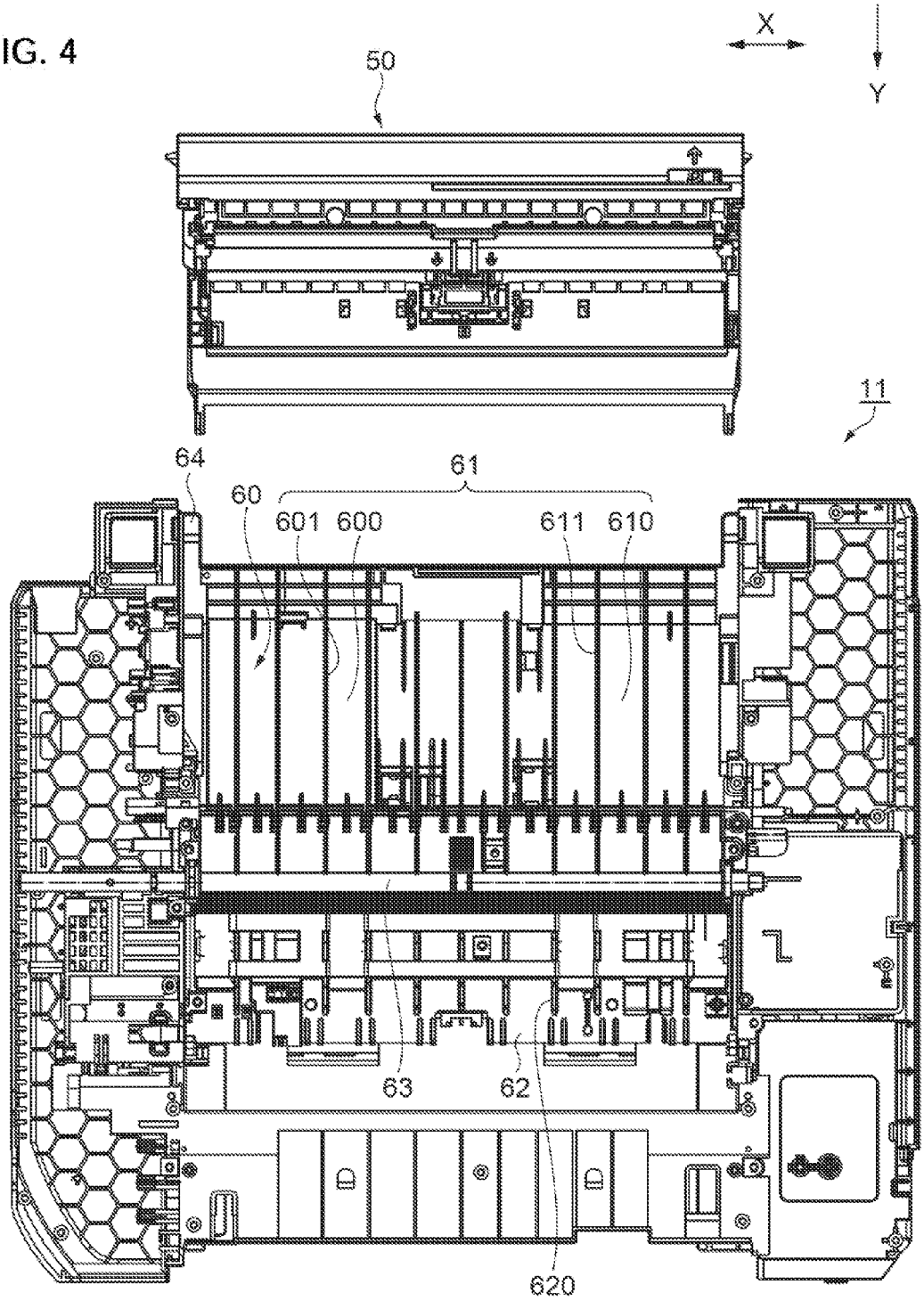
FIG. 4 is a plan view of the recording device with the reversing unit being removed.

FIG. 4 is a plan view of the recording device 11 from the above in the state that the reversing unit 50 is removed. When the reversing unit 50 of FIG. 3A is removed from the frame 64, the entire transportation path 61 disposed on the back side of the recording device 11 is exposed as shown in FIG. 4.

Figure 5:
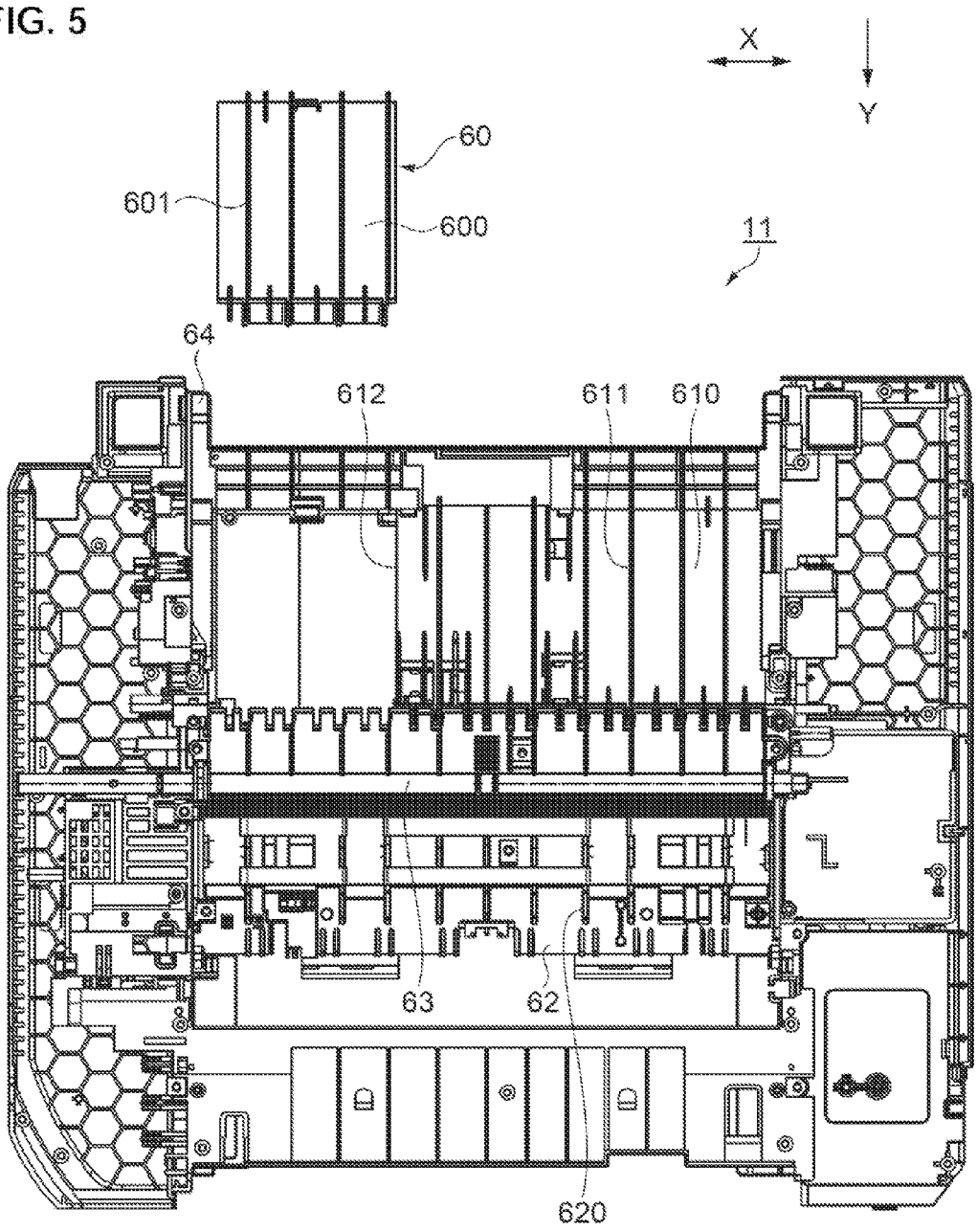
FIG. 5 is a plan view of the recording device with a cartridge being removed from a transportation path.
Figure 6:
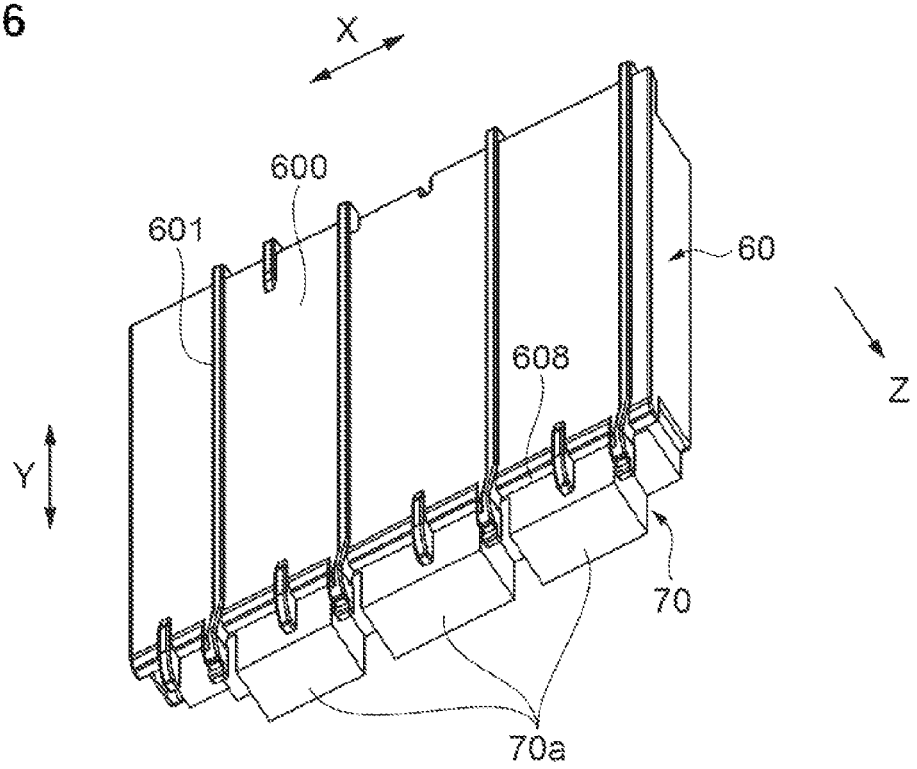
FIG. 6 is a perspective view of the cartridge with a liquid absorbent being housed.

FIG. 5 is a plan view of the recording device 11 from the above in the state that the cartridge 60 is removed from the transportation path 61. FIG. 6 is a perspective view of the cartridge 60 with a liquid absorbent 70 is housed therein. The liquid absorbent 70 that absorbs ink is housed in the cartridge 60 of FIG. 6.

Figure 7A:
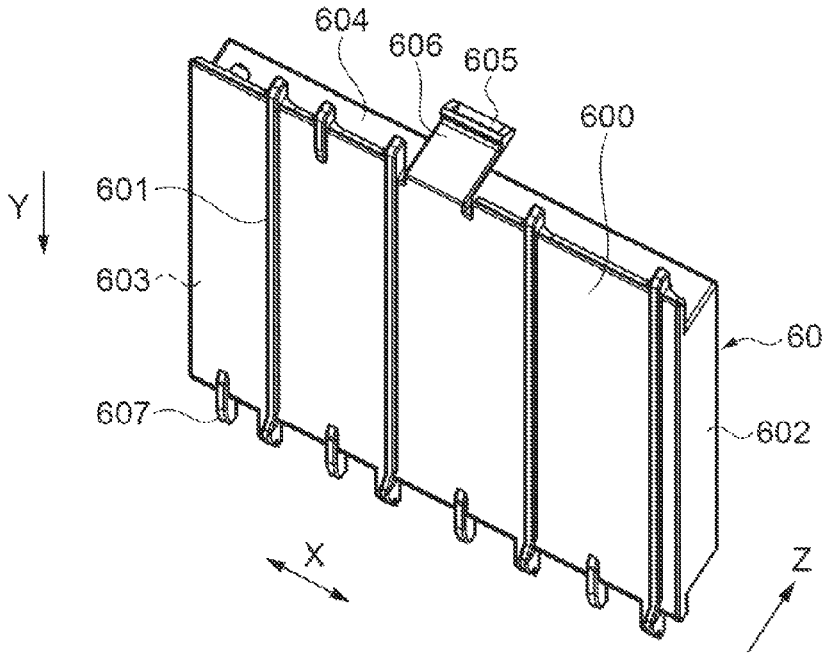
FIGS. 7A and 7B are perspective views of the cartridge.
Figure 7B:
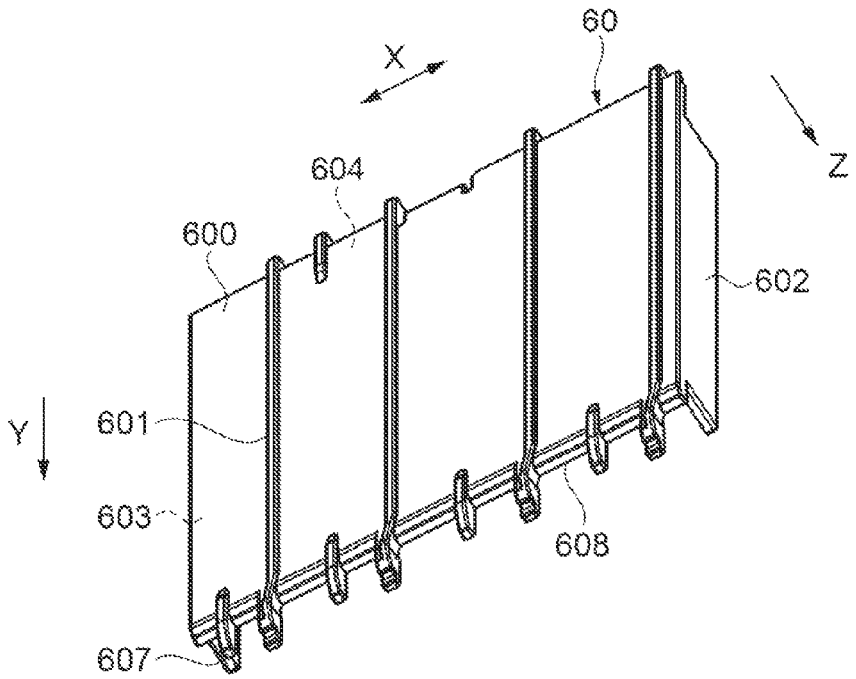
Figure 8A:
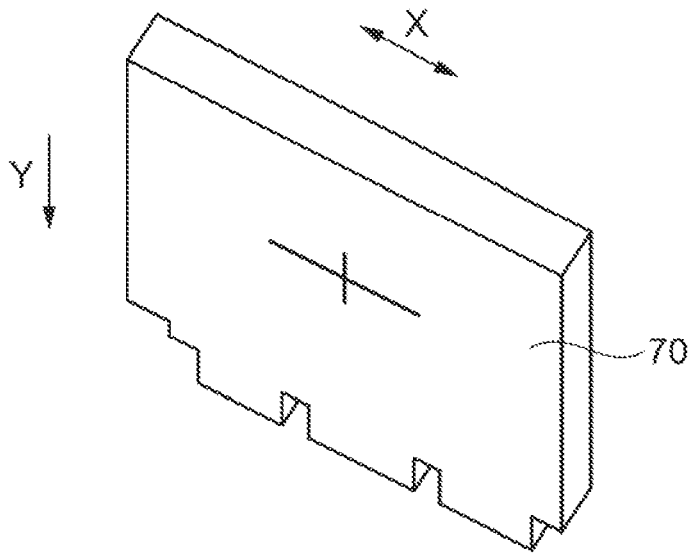
FIGS. 8A and 8B are perspective views of the liquid absorbent.
Figure 8B:
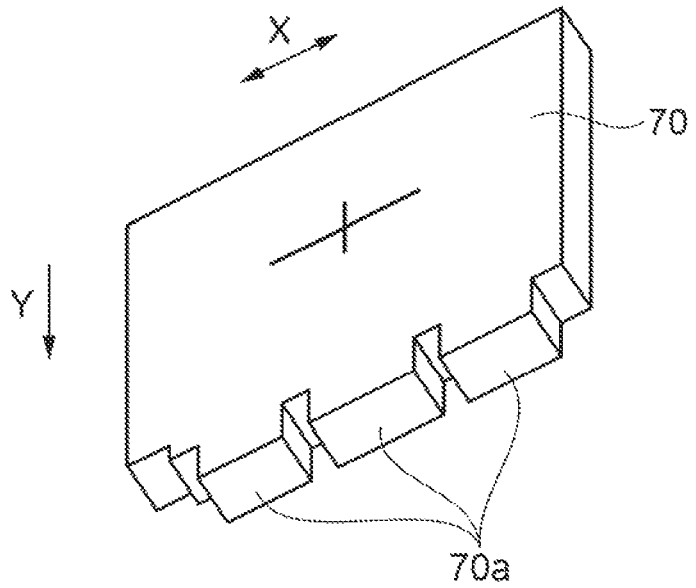

FIG. 7A is a perspective view of the cartridge 60 as seen from the upstream side in the transportation direction Y, and FIG. 7B is a perspective view of the cartridge 60 as seen from the downstream side in the transportation direction Y. FIG. 8A is a perspective view of the liquid absorbent 70 as seen from the upstream side in the transportation direction Y, and FIG. 8B is a perspective view of the liquid absorbent 70 as seen from the downstream side in the transportation direction Y.

The cartridge 60 of FIGS. 7A and 7B has a wall 600 and a plurality of ribs 601 that extend upward from the wall 600 in the transportation direction Y. An engaging unit 605 and a support unit 606 that is elastically deformable and supports the engaging unit 605 are formed on the cartridge 60 at a position upstream in the transportation direction Y. Further, the engaging units 607 that extend downstream in the transportation direction Y are formed on the cartridge 60 at a position downstream in the transportation direction Y.

The engaging units 605 and 607 can engage with and disengage from engaged units (not shown in the figure) provided on the wall that form the transportation path 61. Accordingly, the cartridge 60 of FIG. 5 can be mounted in an opening 612 provided in the transportation path 61 and removed from the opening 612.

The cartridge 60 of FIGS. 7A and 7B has a wall 604 that extends downward from the wall 600 and extends in the width direction X at an upstream position. Further, the cartridge 60 has walls 602 and 603 that extend downward from the wall 600 and extends in the transportation direction Y at each end in the width direction X. The liquid absorbent 70 of FIGS. 8A and 8B can be surrounded by the walls 602, 603 and 604 and housed in the cartridge 60.

Since a wall is not provided at an end 608 of the cartridge 60 downstream in the transportation direction Y as shown in FIG. 7B, the liquid absorbent 70 of FIG. 6 is disposed in the cartridge 60 with an end face 70*a* extending from the end 608.

As shown in FIG. 4, when the cartridge 60 is mounted in the opening 612 (see FIG. 5), the transportation path 61 is formed by the wall 610 that is secured on the frame 64, a plurality of ribs 611 that are arranged in the width direction X and that extend upward from the wall 610 in the transportation direction Y, the wall 600 of cartridge 60 and a plurality of ribs 601.

Figure 14:
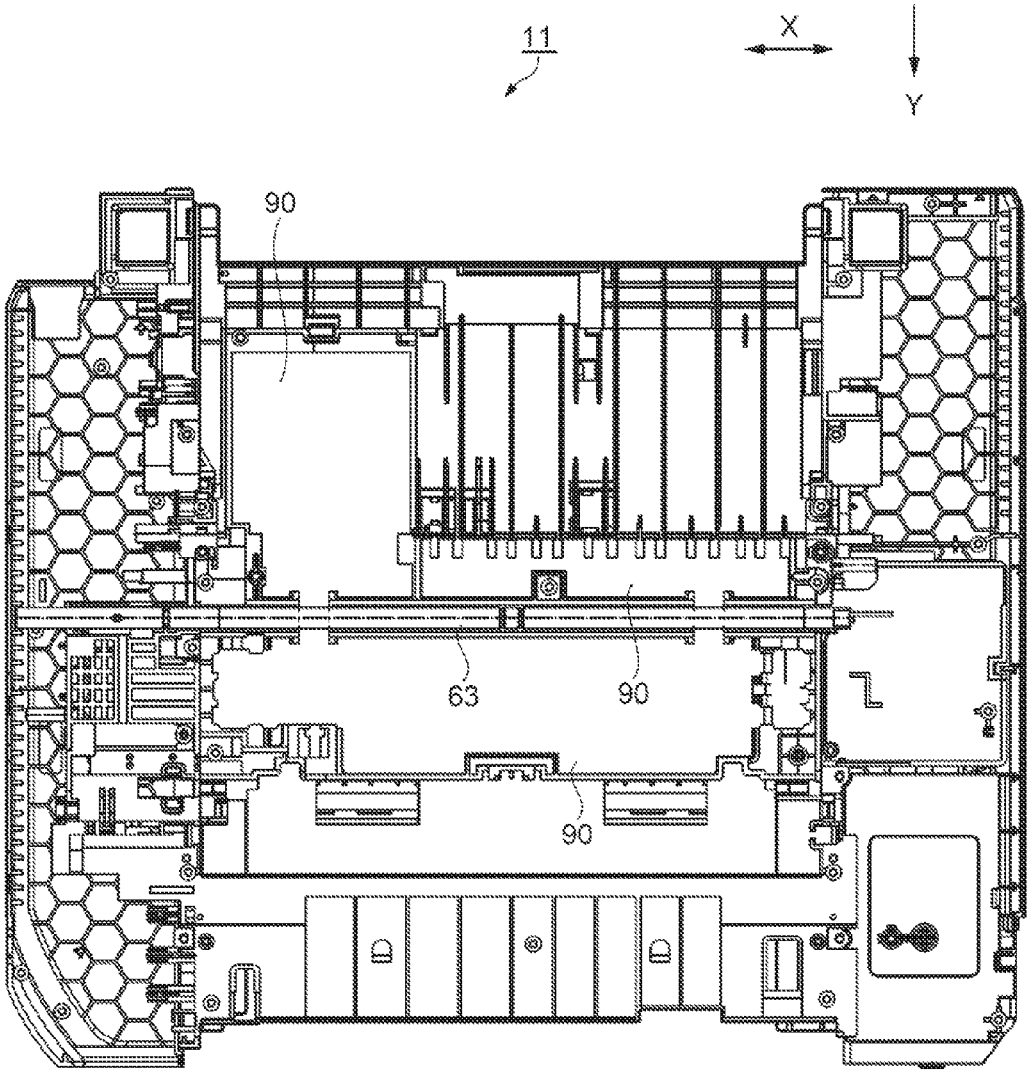
FIG. 14 is a plan view of the recording device which shows a range in which the liquid absorbent is positioned.

FIG. 14 is a plan view of the recording device 11 from the above which shows a range 90 in which the liquid absorbent is positioned. The liquid absorbent is positioned in the transportation path 61 upstream in the transportation direction Y relative to an area where ink is ejected from the liquid ejection head 25, and along a surface of transportation path downstream in the transportation direction Y.

Figure 9:
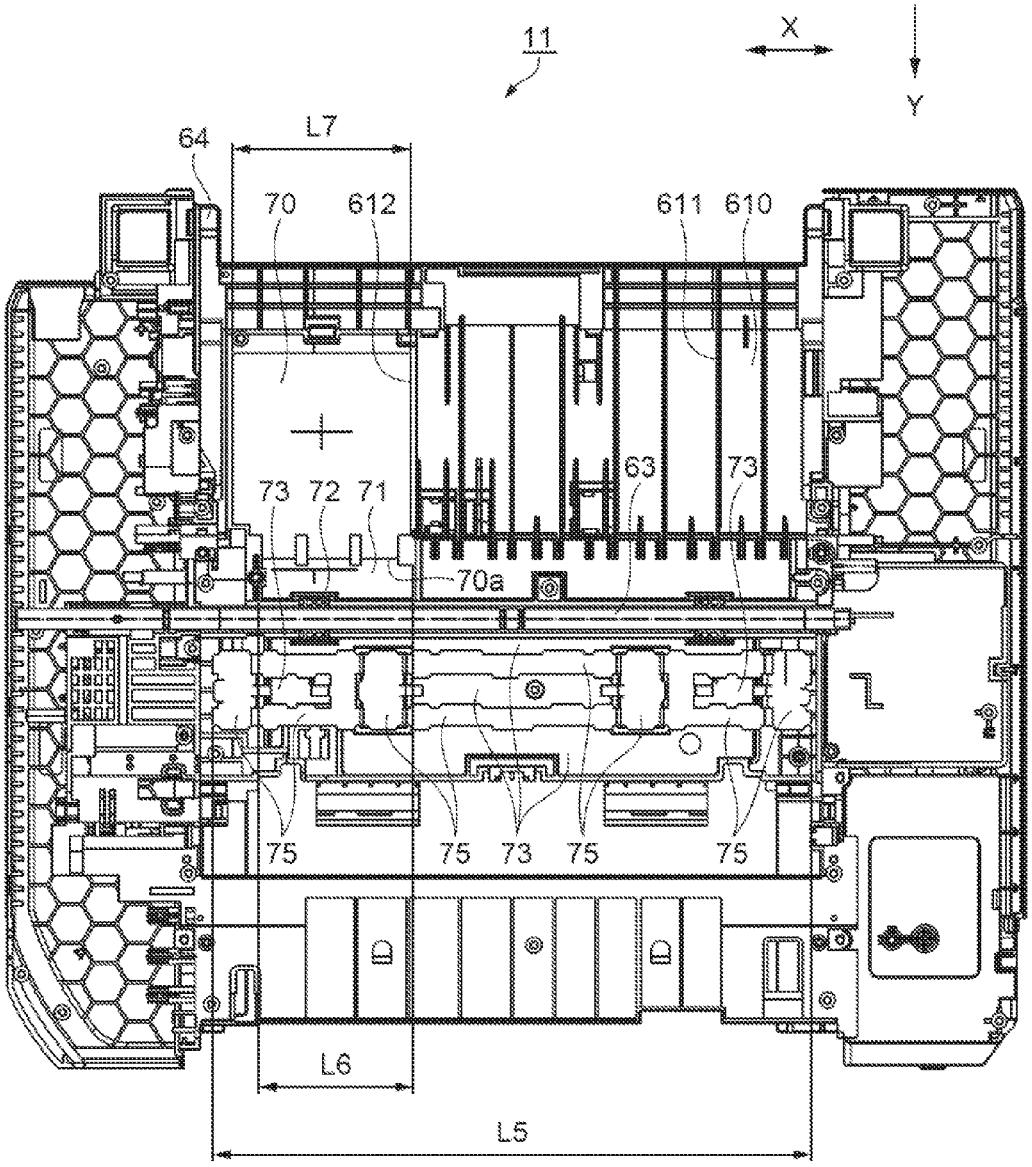
FIG. 9 is a plan view of the recording device which shows an arrangement of the liquid absorbent.

FIG. 9 a plan view of the recording device 11 from the above which shows an arrangement of the liquid absorbent. FIG. 9 is a view which shows that the support unit 62 is removed from the recording device 11 of FIG. 4, and shows the liquid absorbent 70 is positioned without showing the cartridge 60.

A liquid absorbent 73 is positioned downstream in the transportation direction Y relative to the transportation roller 63. The liquid absorbents 70, 71 are positioned opposite to the liquid absorbent 73 with the transportation roller 63 therebetween, that is, upstream in the transportation direction Y relative to the liquid absorbent 73. the liquid absorbent 71 is positioned downstream in the transportation direction Y relative to the liquid absorbent 70. the liquid absorbent 71 abuts against the end face 70*a* of the liquid absorbent 70 of FIG. 6.

Figure 10:
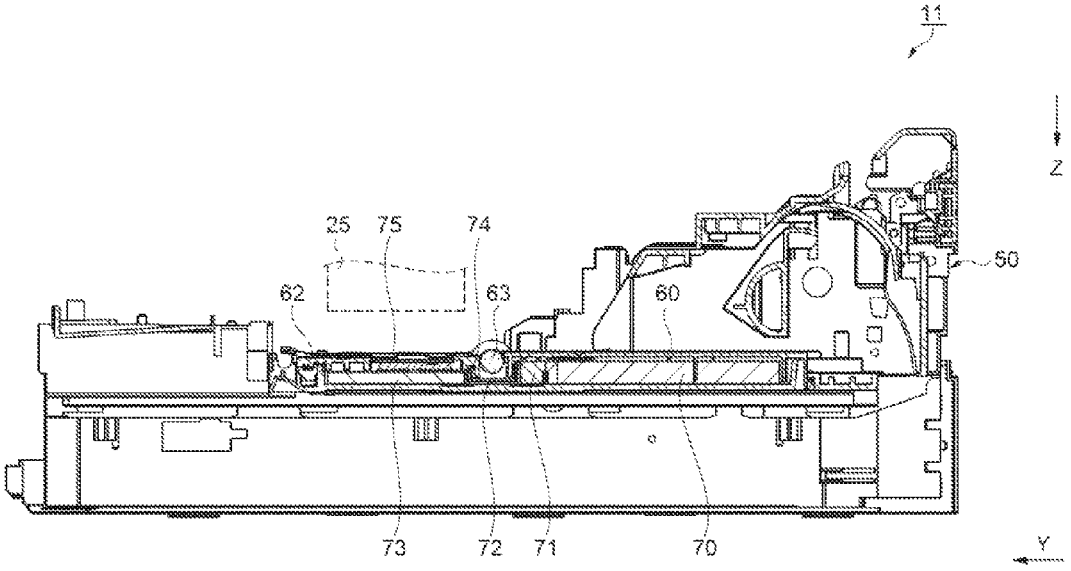
FIG. 10 is a sectional view of the recording device.
Figure 11:
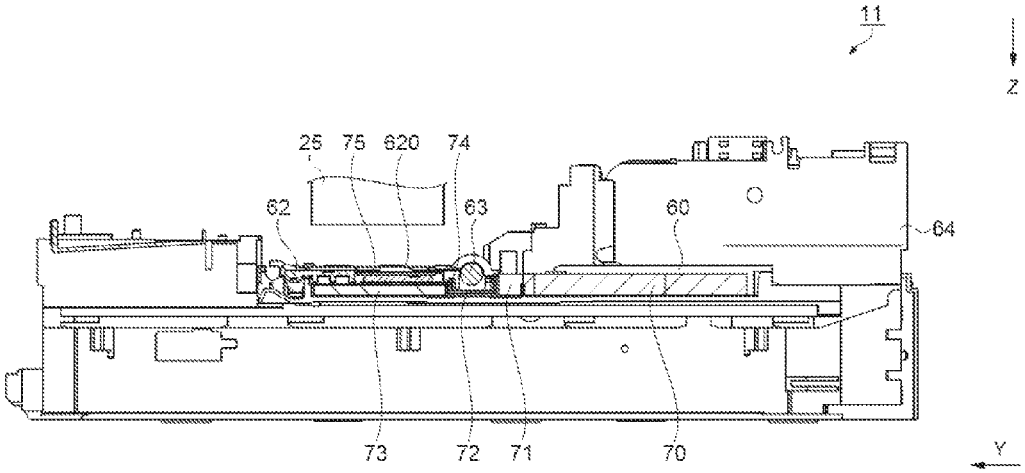
FIG. 11 is a sectional view of the recording device.

FIG. 10 is a sectional view of the recording device 11 taken along the dashed and dotted line A-A' of FIG. 3A as seen in the arrow direction and shows that the reversing unit 50 is mounted above the cartridge 60 that houses the liquid absorbent 70. FIG. 11 is a sectional view of the recording device 11 taken along the dashed and dotted line A-A' of FIG. 3A as seen in the arrow direction and shows that the reversing unit 50 of FIG. 9 is removed.

As shown in FIG. 11, the liquid absorbent 73 is positioned opposite to the liquid ejection head 25 with respect to the support unit 62 that has the ribs 620, that is, under the support unit 62. The second liquid absorbent 72 is positioned between the liquid absorbent 73 and the liquid absorbent 71 in the transportation direction Y. The second liquid absorbent 72 is positioned under the transportation roller 63.

A third liquid absorbent 75 is positioned above the liquid absorbent 73. The third liquid absorbent 75 is mounted on the support unit 62. A projection 751 that extends downward is formed on the underside of the third liquid absorbent 75 so as to abut against the upper side of the liquid absorbent 73 (see FIG. 12A).

When forming an image on the paper sheet P without margins by ejecting ink from the liquid ejection head 25 of FIG. 1A, ink is ejected to the outside of the paper sheet P. The ink ejected to the outside of the end of the paper sheet P in the transportation direction Y and the width direction X lands on the third liquid absorbent 75 of FIG. 11 and is absorbed by the third liquid absorbent 75. The ink absorbed by the third liquid absorbent 75 is then absorbed by the liquid absorbent 73, the second liquid absorbent 72, the liquid absorbent 71 and the liquid absorbent 70, in sequence.

Figure 12A:
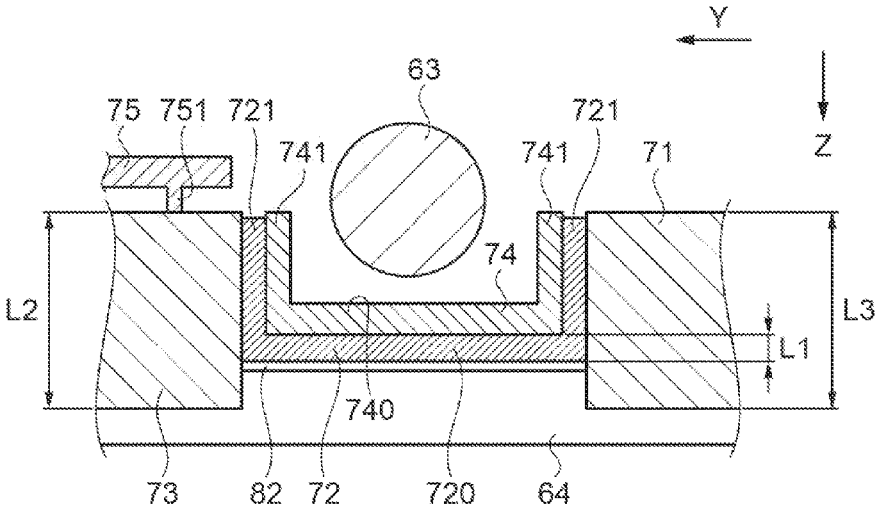
FIG. 12A is an enlarged sectional view of a portion in which the liquid absorbents abut with each other.
Figure 12B:
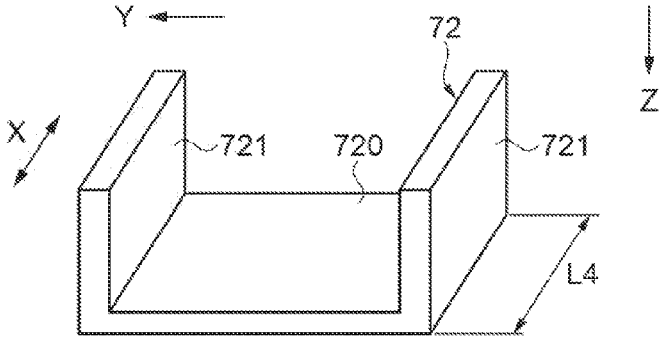
FIG. 12B is a perspective view of the liquid absorbent.

FIG. 12A is an enlarged sectional view of a portion in which the liquid absorbents 71, 73 abut against the second liquid absorbent 72 as seen in the width direction X. FIG. 12B is a perspective view of the second liquid absorbent 72. The second liquid absorbent 72 is positioned on the frame 64 under the transportation roller 63.

Both ends 721 of the second liquid absorbent 72 in the transportation direction Y extend upward and abut against the end of the liquid absorbents 71, 73. This increases a surface area of each side face of the ends 721 of the second liquid absorbent 72 which abuts against the side face of the liquid absorbents 71, 73, thereby increasing the amount of ink absorbed from the liquid absorbent 73 to second liquid absorbent 72 and the amount of ink flowing from the second liquid absorbent 72 to the liquid absorbent 71.

Figure 12C:
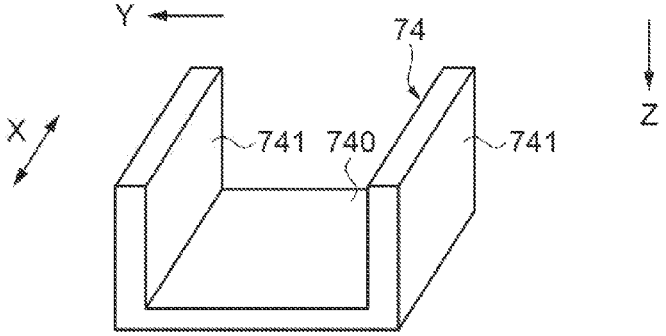
FIG. 12C is a perspective view of a holding member.

FIG. 12C is a perspective view of the holding member 74. The holding member 74 is placed on the second liquid absorbent 72. Both ends 741 of the holding member 74 in the transportation direction Y extend upward and abut against the inner face of the ends 721 of the second liquid absorbent 72, that is, the holding member 74 is inserted in the second liquid absorbent 72. This prevents the second liquid absorbent 72 from being displaced upward out of a recess 81 of the frame and abutting against the transportation roller 63.

Figure 13:
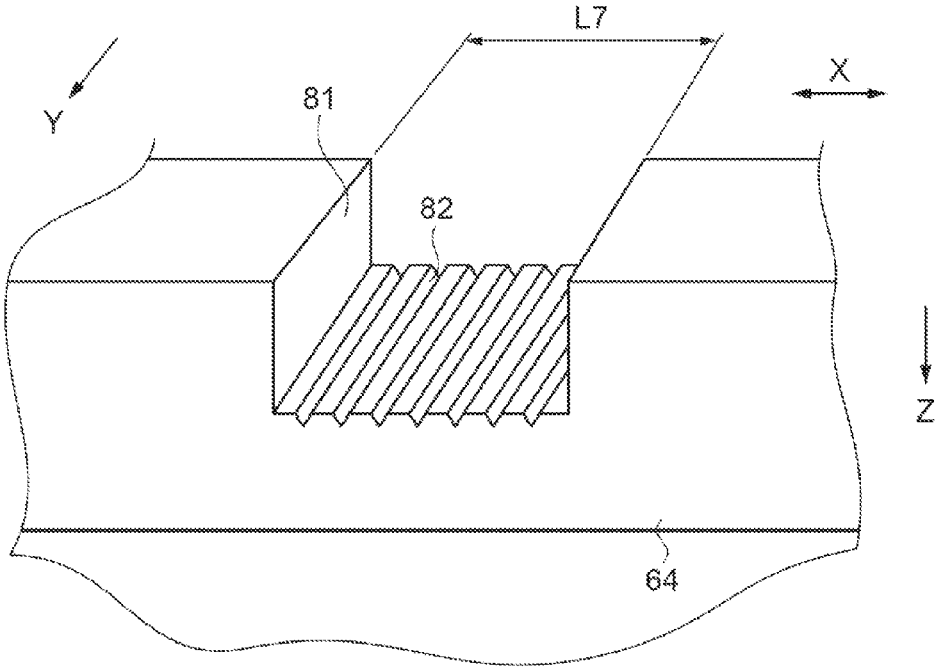
FIG. 13 is a perspective view of a recess of a frame.

FIG. 13 is a perspective view of the recess 81 of the frame 64. A plurality of channels 82 that extend in the transportation direction Y are formed at the bottom of the recess 81 of the frame 64. A bottom 720 of the second liquid absorbent 72 of FIG. 12A covers the channels 82 so that flow paths are formed between the bottom 720 and the frame 64. Accordingly, the amount of ink flowing from the liquid absorbent 73 to the liquid absorbent 71 via the second liquid absorbent 72 can be increased.

Although the channels 82 of FIG. 13 each have a triangular sectional shape in the transportation direction Y, the sectional shape may be a semi-circular shape or rectangular shape.

The liquid absorbents 70, 71, 73, the second liquid absorbent 72 and the third liquid absorbent 75 are formed of a non-woven fabric made of pulp or synthetic fiber. The second liquid absorbent 72 has a liquid diffusivity higher than that of the liquid absorbents 70, 71, 73. The third liquid absorbent 75 is made of the same material as that of the second liquid absorbent 72.

Since the liquid diffusivity of the second liquid absorbent 72 is higher than that of the liquid absorbent 70, 71, 73, the thickness L1 of the second liquid absorbent 72 of FIG. 12A can be smaller than the thickness L2 of the liquid absorbent 73, the thickness L3 of the liquid absorbent 71, and the thickness (not shown in the figure) of the liquid absorbent 70. Further, in the width direction X, the width L4 of the second liquid absorbent 72 of FIG. 12B can be smaller than the width L5 of the liquid absorbent 73 of FIG. 9, the width L6 of the liquid absorbent 71 and the width L7 of the liquid absorbent 70.

Further, since the thickness L1 of the second liquid absorbent 72 can be small, a distance from an upper end of the transportation roller 63 to a lower end of the second liquid absorbent 72 in the vertical direction Z can be small. Accordingly, this can prevent a height of the recording device 11 in the vertical direction Z from being increased.

Further, since the width L4 of the second liquid absorbent 72 can be small, a length L7 of the recess 81 of the frame 64 of FIG. 13 in the width direction X can be small. Accordingly, this can prevent a rigidity of the frame 64 from being decreased.

As described above, the recording device 11 of FIGS. 1A and 1B in the present embodiment includes the liquid ejection head 25 that ejects ink onto the paper sheet P that is transported, the support unit 62 that opposes the liquid ejection head 25 and supports the paper sheet P, the transportation path 61 that reverses and transports the paper sheet P, and the transportation roller 63 that transports the paper sheet P, and the liquid absorbent 73 is positioned downstream in the transportation direction Y of the paper sheet P relative to the transportation roller 63 of FIG. 10, and the liquid absorbents 70, 71 are positioned upstream in the transportation direction Y of the paper sheet P relative to the transportation roller 63.

The liquid absorbents 70, 71, 73 absorb ink ejected from the liquid ejection head 25 to the outside of the end of the paper sheet P. Further, the second liquid absorbent 72 is positioned between the liquid absorbent 73 disposed downstream in the transportation direction Y and the liquid absorbent 71 disposed upstream in the transportation direction Y.

With this configuration, the liquid absorbents 70, 71, 73 can be positioned away from each other at positions downstream in the transportation direction Y and upstream in the transportation direction Y of the paper sheet P. Accordingly, the thickness and the width of the liquid absorbents 70, 71, 73 can be small, thereby decreasing the size of the recording device 11.

A portion of the liquid absorbent 70 which is located upstream in the transportation direction Y extends under the transportation path 61. Accordingly, the thickness and the width o the liquid absorbent 70 can be small, thereby decreasing the size of the recording device 11.

Further, the cartridge 60 as a liquid absorbent container that houses a portion of the liquid absorbent 70 of FIG. 6 is detachably mounted in the opening 612 provided on the transportation path 61 of FIG. 5. The wall 600 of the cartridge 60 forms part of the transportation path 61.

With this configuration, since the cartridge 60 can be removed from the opening 612 of the transportation path 61, and after the liquid absorbent 70 is replaced, the cartridge 60 can be mounted in the opening 612 of the transportation path 61, replacement of the liquid absorbent 70 can be easily performed.

When the reversing unit 50 of FIG. 2 that transports the paper sheet P is detachably mounted in the frame 64, and the reversing unit 50 is removed from the frame 64, the wall 600 of the cartridge 60 is exposed.

With this configuration, since the user can remove the cartridge 60 from the opening 612 of the transportation path 61 and mount the cartridge 60 again in the opening 612 of the transportation path 61 with the reversing unit 50 being removed from the frame 64, replacement of the liquid absorbent 70 can be easily performed.

The reversing unit 50 of FIG. 10 includes a reversing roller (not shown in the figure) that reverses and transports the paper sheet P. The liquid absorbent 70 is positioned so as to overlap with the reversing roller in the transportation direction Y. With this configuration, even if the amount of liquid absorbed by the liquid absorbent increases, it is possible to prevent the recording device 11 from increasing in size.

The liquid absorbents 70, 71 are positioned so as not to overlap with the feed roller in the movement direction (width direction X) of the liquid ejection head 25. With this configuration, the recording device 11 can be made low profile.

The second liquid absorbent 72 is formed by a member different from that of the liquid absorbent 73 that is disposed downstream in the transportation direction Y relative to the transportation roller 63 and the liquid absorbent 70, 71 that is disposed upstream in the transportation direction Y. The ink diffusivity of the second liquid absorbent 72 is higher than that of the liquid absorbents 70, 71, 73.

With this configuration, in spite of the thickness L1 and the width L4 of the second liquid absorbent 72 being smaller than the thickness and the width of the liquid absorbents 70, 71, 73, it is possible to prevent the amount of ink absorbed from the liquid absorbent 73 and flowing into the liquid absorbents 70, 71 from decreasing. Accordingly, a space for placing the second liquid absorbent 72 does not need to be large, thereby preventing the recording device 11 from increasing in size.

Further, the ends 721 of the second liquid absorbent 72 extend in the thickness direction of the liquid absorbents 70, 71, 73 (vertical direction Z).

With this configuration, since the surface area of the second liquid absorbent 72 abuts against the liquid absorbent 73 and the surface area of the second liquid absorbent 72 abuts against the liquid absorbent 71 can be large, the amount of ink absorbed by the second liquid absorbent 72 from the liquid absorbent 73 and flowing into the liquid absorbent 71 can be increased.

Further, the recess 81 of FIG. 13 that houses the second liquid absorbent 72 is formed in the frame 64 of FIG. 12A between the liquid absorbent 73 and the liquid absorbent 71, and a plurality of channels 82 that extend from the liquid absorbent 73 to the liquid absorbent 71 are formed at the bottom of the recess 81.

With this configuration, since the flow paths are formed between the second liquid absorbent 72 and the bottom of the recess 81, the amount of ink flowing from the liquid absorbent 73 to the liquid absorbent 71 can be increased.

The holding member 74 is provided in the recess 81 so as to oppose the bottom of the recess 81 and abut against the second liquid absorbent 72.

With this configuration, it is possible to prevent the second liquid absorbent 72 from being displaced from the bottom and abutting against surrounding members such as the transportation roller 63.

The third liquid absorbent 75 mounted on the support unit 62 is disposed above the liquid absorbent 73 that is positioned downstream in the transportation direction Y. The third liquid absorbent 75 is in contact with the liquid absorbent 73 that is positioned downstream in the transportation direction Y relative to the transportation roller 63.

With this configuration, since the third liquid absorbent 75 is in contact with the liquid absorbent 73, the amount of ink which is flowing out can be increased.

The third liquid absorbent 75 first absorbs ink ejected from the liquid ejection head 25 to the outside of the end of the paper sheet P.

With this configuration, since the first absorbed ink ejected from the liquid ejection head 25 to the outside of the end of the paper sheet P can be then absorbed by the liquid absorbent 73 which is located under the third liquid absorbent 75, the amount of ink which is flowing out can be increased.

In this embodiment, although the cartridge 60 that houses the liquid absorbent 70 is provided, the cartridge 60 may not be provided and the transportation path that is removable from the frame 64 may be provided with the liquid absorbent provided under the transportation path.

Further, in this embodiment, although the cartridge 60 that houses a portion of the liquid absorbent 70 is provided, the cartridge that houses the entire liquid absorbent 70 may be provided.

Figure 15A:
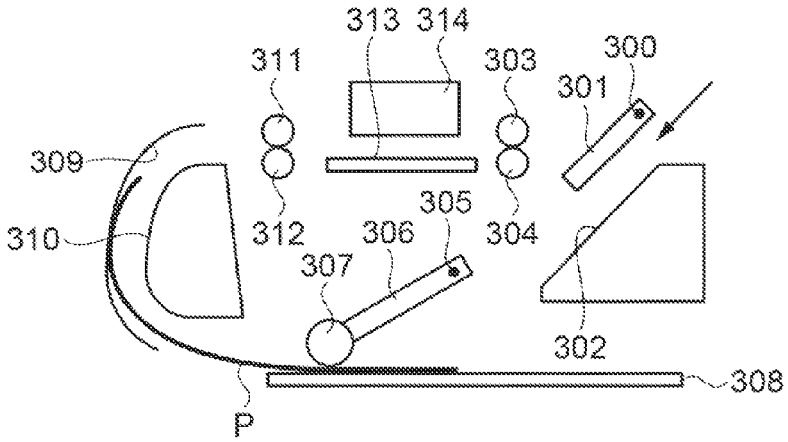
FIGS. 15A to 15C are views which show a paper sheet is reversed in the recording device having a reversing unit which does not have a reversing roller.
Figure 15B:
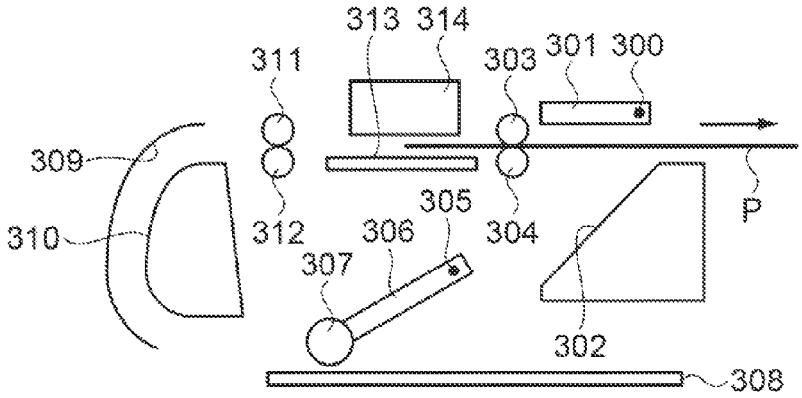
Figure 15C:
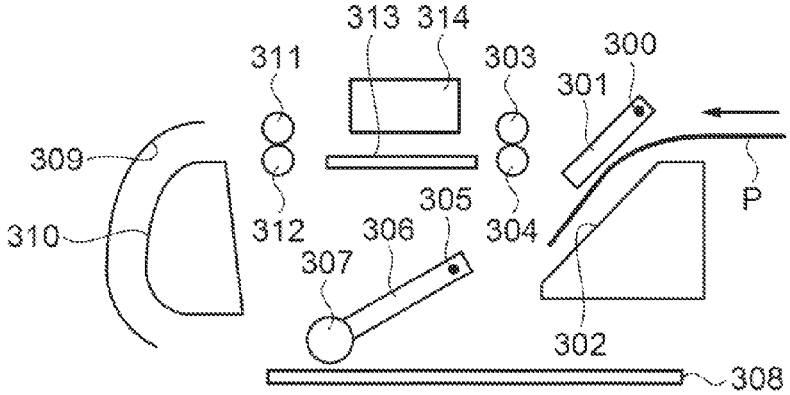

Although the reversing unit 50 of the present example includes the reversing roller that reverses the paper sheet P, the liquid absorbents 70, 71, 73, the second liquid absorbent 72 and the third liquid absorbent 75 may be provided in the recording device having a reversing unit that does not include the reversing roller. FIGS. 15A to 15C show that the paper sheet P is reversed in the recording device having the reversing unit that does not include the reversing roller.

The paper sheet P of FIG. 15A is inserted between a switching member 301 and a guide surface 302 as indicated by the arrow and is transported to the left side of the figure along a support unit 308 by a feed roller 307 which is provided on a sliding member 306 that is rotatable about a pivot axis 305. The leading end of the paper sheet P is transported while being guided by an inner guide surface 310 and an outer guide surface 309 that form a reversing unit.

The paper sheet P is transported as indicated by the arrow of FIG. 15B to the right side of the figure along a support unit 313, a transportation driving roller 312 a transportation driven roller 311, an ejection driving roller 304 and a knurl roller 303 which is an ejection driven roller. Ink is ejected from a liquid ejection head 314 onto the surface of the paper sheet P which is transported to the right side of the figure by the support unit 313 so as to form an image. The switching member 310 which has been in the state shown in FIG. 15A rotates about the pivot axis 300 and becomes to the state shown in FIG. 15B in which the paper sheet P can move to the right side of the figure.

When the tailing edge of the paper sheet P of FIG. 15B reaches the right side of the figure by the switching member 301, the paper sheet P is transported as indicated by the arrow of FIG. 15C to the left side of the figure by a driving roller and a driven roller, which are not shown in the figure, and then transported toward the feed roller 307 while being guided by the switching member 301 which has been rotated to the state shown in FIG. 15C.

Then, the paper sheet P is transported by the feed roller 307 to the left side of the figure along the support unit 308. The paper sheet P is then transported while being guided by the inner guide surface 310 and the outer guide surface 309 that form the reversing unit. Further, the paper sheet P is transported to the right side of the figure along the support unit 313 by the transportation driving roller 312, the transportation driven roller 311, ejection driving roller 304 and the knurl roller 303. Ink is ejected from a liquid ejection head 314 onto the back surface of the paper sheet P which is transported along the support unit 313 so as to form an image on the back surface of the paper sheet P. After the image is formed on the back surface of the paper sheet P, the paper sheet P is ejected to the right side of the figure.

The entire disclosure of Japanese Patent Application No. 2012-152157, filed Jul. 6, 2012 is expressly incorporated by reference herein.

What is claimed is:

1. A recording device comprising:

a liquid ejection head that ejects liquid onto a recording medium that is transported;

an area where the liquid is ejected from the liquid ejection head;

a transportation path that is located between a medium supply unit that supplies the recording medium and a medium ejection unit that ejects the recording medium;

a transportation roller that is located at an upstream side of the liquid ejection head;

a first liquid absorbent that absorbs the ejected liquid in the area;

a second liquid absorbent positioned at least along a surface of the transportation path which is outside of the area, and a third liquid absorbent positioned under the transportation roller, wherein the first liquid absorbent and the second liquid absorbent are fluidly connected by the third liquid absorbent in a direction of the transportation path and the liquid flows from the first absorbent to the second absorbent, wherein the third liquid absorbent is formed by a member different from that of the first liquid absorbent and the second liquid absorbent, wherein the thickness of the third liquid absorbent is thinner than the thickness of the first liquid absorbent and the second liquid absorbent, and wherein one end portion of the third liquid absorbent extends in the thickness direction of the first liquid absorbent and contacts the side portion of the first liquid absorbent, and other end portion of the third liquid absorbent extends in the thickness direction of the second liquid absorbent and contacts the side portion of the second liquid absorbent.

2. The recording device according to claim 1, further comprising a transportation path along which the recording medium is reversed and transported, wherein the liquid absorbent extends under the transportation path.

3. The recording device according to claim 1, further comprising a transportation path along which the recording medium is reversed and transported, wherein the third liquid absorbent extends under the transportation path.

4. The recording device according to claim 2, further comprising a reversing unit having a reversing roller that reverses and transports the recording medium, wherein the liquid absorbent is positioned so as to overlap with the reversing roller in the transportation direction.

5. The recording device according to claim 3, further comprising a reversing unit having a reversing roller that reverses and transports the recording medium, wherein the second liquid absorbent is positioned so as to overlap with the reversing roller in the transportation direction.

6. The recording device according to claim 4, further comprising a liquid absorbent container that houses at least a portion of the liquid absorbent and is detachably mounted in the transportation path, wherein a wall of the liquid absorbent container forms part of the transportation path.

7. The recording device according to claim 5, further comprising a liquid absorbent container that houses at least a portion of the second liquid absorbent and is detachably mounted in the transportation path, wherein a wall of the liquid absorbent container forms part of the transportation path.

8. The recording device according to claim 6, wherein the reversing unit is detachably mounted on a frame, and the wall of the liquid absorbent container is exposed when the reversing unit is removed from the frame.

9. The recording device according to claim 7, wherein the reversing unit is detachably mounted on a frame, and the wall of the liquid absorbent container is exposed when the reversing unit is removed from the frame.

10. The recording device according to claim 8, further comprising:

a feed cassette on which the recording medium is placed; and a feed roller that feeds the recording medium placed on the feed cassette, wherein the liquid absorbent is positioned so as not to overlap with the feed roller in the movement direction of the liquid ejection head.

11. The recording device according to claim 9, further comprising:

a feed cassette on which the recording medium is placed; and a feed roller that feeds the recording medium placed on the feed cassette, wherein the second liquid absorbent is positioned so as not to overlap with the feed roller in a movement direction of the liquid ejection head.

12. The recording device according to claim 1, wherein the first liquid absorbent and the second liquid absorbent are nearly identical in height in a height direction.

13. The recording device according to claim 1, wherein the second liquid absorbent is positioned so as to overlap with the transportation roller in a height direction of the recording device.

14. The recording device according to claim 1, wherein a fourth liquid absorbent is installed under the transportation roller.

15. The recording device according to claim 1 wherein an upper surface of the first liquid absorbent or an upper surface of the second liquid absorbent overlaps the transportation roller in a height direction on both the upstream and the downstream side.

* * * * *